US007517842B2

(12) United States Patent
Barnhart et al.

(10) Patent No.: US 7,517,842 B2
(45) Date of Patent: Apr. 14, 2009

(54) ANTIMICROBIAL WASH FORMULATIONS INCLUDING AMIDOAMINE-BASED CATIONIC SURFACTANTS

(75) Inventors: Ronald A. Barnhart, Clinton, OH (US); David P. Lerner, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 6 days.

(21) Appl. No.: 11/595,074

(22) Filed: Nov. 10, 2006

(65) Prior Publication Data

US 2008/0113892 A1 May 15, 2008

(51) Int. Cl.
*C11D 1/70* (2006.01)
*C11D 3/48* (2006.01)
*C11D 1/40* (2006.01)

(52) U.S. Cl. ..... 510/138; 510/130; 510/131; 510/382; 510/386; 510/388; 510/499

(58) Field of Classification Search ..... 510/130, 510/131, 138, 382, 386, 388, 499
See application file for complete search history.

(56) References Cited

U.S. PATENT DOCUMENTS 5,194,252 A * 3/1993 Hofmann ..... 424/73
5,573,726 A * 11/1996 Dassanayake et al. ..... 422/28
5,641,480 A * 6/1997 Vermeer ..... 424/70.24
5,681,802 A * 10/1997 Fujiwara et al. ..... 510/130
5,916,586 A * 6/1999 Villa et al. ..... 424/443
5,925,348 A * 7/1999 Riley et al. ..... 424/94.5
6,026,822 A * 2/2000 Skiba et al. ..... 132/212
6,613,729 B1 * 9/2003 Cole et al. ..... 510/405
6,806,250 B2 * 10/2004 Mimoun et al. ..... 512/1
7,150,876 B2 * 12/2006 Chaudhuri et al. ..... 424/401
2003/0215471 A1 * 11/2003 Wilmott et al. ..... 424/401
2004/0018164 A1 * 1/2004 Zofchak et al. ..... 424/70.13
2006/0160230 A1 * 7/2006 Esswein et al. ..... 436/77
2006/0287215 A1 * 12/2006 McDonald et al. ..... 510/441
2007/0202069 A1 * 8/2007 Tamareselvy et al. .... 424/70.12
2007/0202073 A1 * 8/2007 Fenyvesi et al. ..... 424/70.31
2007/0277331 A1 * 12/2007 Goldstein et al. ..... 8/406

* cited by examiner

*Primary Examiner*—Charles I Boyer
(74) *Attorney, Agent, or Firm*—Renner, Kenner, Greive, Bobak, Taylor & Weber

(57) ABSTRACT

An antimicrobial hand wash comprises an active ingredient and an amidoamine based cationic surfactant having a fatty chain with from 6 to 24 carbon atoms. These cationic surfactants are compatible with common active ingredients such that antimicrobial efficacy is maintained, while foam quality is improved when the hand wash is dispensed as foam. Other antimicrobial hand washes include specific amidoamine based cationic surfactants that dissolve at least a portion of the active ingredient, thus reducing the amount of solids in the formulation, and, in some instances, making a cold manufacturing process possible.

9 Claims, No Drawings

ANTIMICROBIAL WASH FORMULATIONS INCLUDING AMIDOAMINE-BASED CATIONIC SURFACTANTS

TECHNICAL FIELD OF THE INVENTION

The present invention resides in the art of antimicrobial hand wash formulations. More particularly, the present invention relates to a highly efficacious antimicrobial hand wash containing primary surfactants derived from amidoamines.

BACKGROUND OF THE INVENTION

Most antimicrobial hand wash formulations exhibiting broad-spectrum activity contain surfactants, active ingredients, or both. Surfactants are employed, in part, to help solublize the active ingredients, and to make them useful in the formulation. The surfactants are typically selected from anionic, non-ionic, amphoteric, quaternary ammonium, and amine oxide surfactants. As is generally appreciated, all of these classes of surfactants have their advantageous and disadvantageous properties. For example, quaternary ammonium compounds are compatible with phenol active ingredients (e.g., triclosan and pcmx), but do not foam to a great extent. Amphoteric surfactants and amine oxides are expensive compared to other surfactant classes. The active ingredients for which the surfactants are chosen are typically selected from bisguanidines, diphenyl compounds, quaternary ammonium compounds, benzyl alcohols, trihalocarbanilides, iodine containing compounds, ethoxylated phenols, and phenolic compounds such as triclosan (2,3,4'-trichloro-2'-hydroxydiphenylether) and parachlorometaxylenol (pcmx). There are numerous limitations to using active ingredients when used in conjunction with surfactants. Because many types of surfactants, typically anionic, amphoteric and non-ionic surfactants, deactivate active ingredients, it has been found necessary to employ surfactant combinations to achieve desired properties.

Although compatible with numerous active ingredients, amine oxides and quaternary ammonium compounds are expensive and yield formulations with sub-par aesthetic properties. Phenolic active ingredients are only sparingly soluble in water therefore requiring solvents, such as propylene glycol, and hydrtropes, such as sodium xylene sulfonate and the primary surfactants are required to dissolve the insoluble compounds. Solvents and hydrotropes are usually detrimental to the final formulation, either because they increase cost or increase irritancy. In order to avoid the negative affects of solvents and hydrotropes the solution can be heated to dissolve the phenolic active ingredient, but this requires large amounts of energy and an extended manufacturing time. A hand wash that is low in solids would offer the advantages of reduced cost combined with a probable reduction in irritation through minimizing the use of irritating surfactants.

It might be desirable to provide antimicrobial hand wash formulations that foam. When foaming is desired, it has been found that high-foaming amphoteric and non-ionic surfactants are the preferred surfactants, but most of them are incompatible with, and even deactivate, phenolic compounds such as triclosan, making their use with this active ingredient less desirable. Amine oxides are commonly used primary surfactants in antimicrobial hand washes because they do not inhibit the efficacious properties of the active compound. However, amine oxides cost significantly more than some other amphoteric and non-ionic surfactants. Thus, there exists a need in the art for a low cost antimicrobial hand wash formulation that includes a primary surfactant that does not negatively impact the efficacy of the active ingredient(s).

SUMMARY OF THE INVENTION

In general, this invention provides an antimicrobial hand wash comprising an active ingredient and a cationic surfactant. The cationic surfactant is produced from the neutralization of an amidoamine with an acid, wherein the amidoamine is selected to have a primary fatty chain with from 6 to 24 carbon atoms. In a particular embodiment, the amidoamine is lauramidopropyl dimethylamine, and it is neutralized with lactic acid to provide lauramidopropyl dimethylamine lactate. The low carbon chain length in the surfactant enables the hand wash to be conducive to foaming, and foam quality is improved when the hand wash is dispensed as foam.

For purposes of this disclosure, the terms "active ingredient" and "actives" are to cover compositions that produce acceptable time-kill antimicrobial activity to be suitable for use as a sanitizer. The antimicrobial hand wash contains at least one active ingredient. The term "active ingredient" is generally appreciated as a term of art for those compounds that are discussed in the United States Food and Drug Administration's Tentative Final Over-the-Counter Monograph. In this invention, sanitizing hands is the main focus, and active ingredients for antimicrobial hand wash formulations may be selected from any suitable known or hereafter discovered active ingredient. By way of non-limiting example, these may include bisguanidines, diphenyl compounds, quaternary ammonium compounds, benzyl alcohols, trihalocarbanilides, ethoxylated phenols, iodine and iodine containing compounds and phenolic compounds, and mixtures of the foregoing. In particular, preferred hand washes herein should have greater than 3 log kill on both gram negative bacteria, specifically *Klebsiella pheumoniae,* and gram positive bacteria, specifically *Staphylococcus aureus.* Non-limiting examples of suitable active ingredients include those selected from the group consisting of bisguanidines, diphenyl compounds, quaternary ammonium compounds, benzyl alcohols, trihalocarbanilides, ethoxylated phenols, iodine and iodine containing compounds, and phenolic compounds and mixtures of the foregoing. Particularly useful actives include the phenolic compounds triclosan and parachlorometaxylenol (pcmx).

In another embodiment, this invention provides an antimicrobial hand wash comprising a phenolic compound active ingredient, and a cationic surfactant produced from the neutralization of an amidoamine with an acid, wherein the amidoamine is selected to have a primary fatty chain with from 6 to 24 carbon atoms. In particular embodiments, the cationic surfactant is selected from acid-neutralized lauramidopropyl dimethylamine, acid-neutralized cocamidopropyl dimethylamine, and acid-neutralized ricinoleamdioproyl dimethylamine. These acid-neutralized amidoamines have been found to have the unexpected and unique ability to solubilize the stated phenolic compounds at low use levels, even upon dilution of the formulation into water. Thus, by employing such a select group of surfactants, the total solids amount in the formula is minimized to reduce irritation to the skin. The reduction in solids content is a result of not having to employ a significant amount of additional solubilizing surfactants and/or glycols.

A method for producing an antimicrobial hand wash is also provided. This method includes the steps of creating an active ingredient premix comprised of a cationic surfactant selected from acid-neutralized lauramidopropyl dimethylamine, acid-neutralized cocamidopropyl dimethylamine, and acid-neutralized ricinoleamdioproyl dimethylamine and mixtures thereof, and an active ingredient selected from triclosan and pcmx, wherein the cationic surfactant dissolves at least a portion of the active ingredient. Because the cationic surfactant dissolves at least a portion of the active ingredient, it is not necessary in this method to add heat to dissolve the active ingredient. This method can be carried out at ambient temperature, yielding related costs savings and simplifying antimicrobial hand wash production.

DETAILED DESCRIPTION OF PREFERRED EMBODIMENTS

Antimicrobial hand washes in accordance with this invention are aqueous hand washes including at least one active ingredient incorporated into water with at least one amidoamine based cationic surfactant. As is generally common in the art, to produce an acceptable end hand wash product, multiple surfactants are employed, as are skin conditioning agents, pH adjusting agents, foaming agents (if desired to foam), preservatives, dyes, fragrances, and the like.

In this invention, sanitizing hands is the main focus, and active ingredients for antimicrobial hand wash formulations may be selected from any suitable known or hereafter discovered active ingredient. By way of non-limiting example, these may include bisguanidines, diphenyl compounds, quaternary ammonium compounds, benzyl alcohols, trihalocarbanilides, ethoxylated phenols, iodine and iodine containing compounds and phenolic compounds, and mixtures of the foregoing.

Phenolic compounds are particularly preferred active ingredients. The phenol-based antimicrobial agents useful in this invention are exemplified by the following compounds, and may be used alone or in combination:

(a) 2-Hydroxydiphenyl Compounds

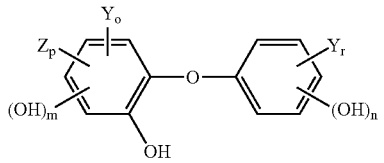

wherein Y is chlorine or bromine, Z is $SO_2$ H, $NO_2$, or $C_1$-$C_4$ alkyl, r is 0 to 3, o is 0 to 3, p is 0 or 1, m is 0 or 1, and n is 0 or 1. In preferred embodiments, Y is chlorine or bromine, m is 0, n is 0 or 1, o is 1 or 2, r is 1 or 2, and p is 0. In especially preferred embodiments, Y is chlorine, m is 0, n is 0, o is 1, r is 2, and p is 0. A particularly useful 2-hydroxydiphenyl compound has the structure:

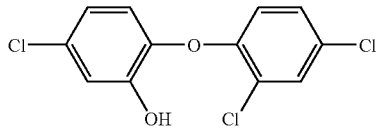

having the adopted name, triclosan, and available commercially under the tradename IRGASAN DP100, from Ciba Specialty Chemicals Corp., Greensboro, N.C. Another useful 2-hydroxydiphenyl compound is 2,2'-dihydroxy-5,5'-dibromodiphenyl ether. Additional bisphenolic compounds are disclosed in U.S. Pat. No. 6,113,933, incorporated herein by reference.

(b) Phenol Derivatives

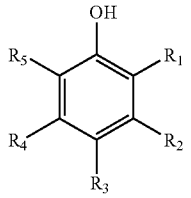

wherein $R_1$ is hydro, hydroxy, $C_1$-$C_4$ alkyl, chloro, nitro, phenyl, or benzyl; $R_2$ is hydro, hydroxy, $C_1$-$C_6$ alkyl, or halo; $R_3$ is hydro, $C_1$-$C_6$ alkyl, hydroxy, chloro, nitro, or a sulfur in the form of an alkali metal salt or ammonium salt; R.sub.4 is hydro or methyl; and $R_5$ is hydro or nitro. Halo is bromo or, preferably, chloro.

Specific examples of phenol derivatives include, but are not limited to, chlorophenols (o-, m-, p-), 2,4-dichlorophenol, p-nitrophenol, picric acid, xylenol, p-chloro-m-xylenol, cresols (o-, m-, p-), p-chloro-m-cresol, pyrocatechol, resorcinol, 4-n-hexylresorcinol, pyrogallol, phloroglucin, carvacrol, thymol, p-chlorothymol, o-phenylphenol, o-benzylphenol, p-chloro-o-benzylphenol, phenol, 4-ethylphenol, and 4-phenolsulfonic acid. Other phenol derivatives are listed in WO 98/55096 and U.S. Pat. No. 6,113,933, incorporated herein by reference.

(c) Diphenyl Compounds

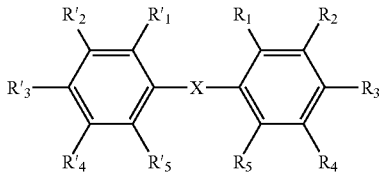

wherein X is sulfur or a methylene group, $R_1$ and $R'_1$ are hydroxy, and $R_2$, $R'_2$, $R_3$, $R'_3$, $R_4$, $R'_4$, $R_5$, and $R'_5$, independent of one another, are hydro or halo. Specific, nonlimiting examples of diphenyl compounds are hexachlorophene, tetrachlorophene, dichlorophene, 2,3-dihydroxy-5,5'-dichlorodiphenyl sulfide, 2,2'-dihydroxy-3,3',5,5'-tetrachlorodiphenyl sulfide, 2,2'-dihydroxy-3,5',5,5',6,6'-hexachlorodiphenyl sulfide, and 3,3'-dibromo-5,5'-dichloro-2,2'-dihydroxydiphenylamine. Other diphenyl compounds are listed in WO 98/55096, incorporated herein by reference.

In particular embodiments, the phenol-based antimicrobial agent is selected from triclosan, 2,2'-dihydroxy-5,5'-dibromodiphenyl ether, pcmx, ortho-phenylphenol, and mixtures thereof. Triclosan and pcmx are most preferred.

In its most basic form, the hand wash formulation further includes at least one amidoamine based cationic surfactant. Generally, amidoamines, without neutralization by an acid, are non-ionic surfactants that might deactivate the active ingredients. Thus, in this invention amidoamines are neutralized so that the compound displays cationic charges and interacts well with the active ingredients. The amidoamines are preferably selected to have a fatty chain with from 6 to 24 carbon atoms. By way of non-limiting example, the amidoamine compounds may include almondamidopropyl dimethylamine, avacadamidopropyl dimethylamine, babassuamidopropyl dimethylamine, behenamidopropyl dimethylamine, cocamidopropyl dimethylamine, cocamidopropyl morpholine, hydroxyethyl carboxymethyl cocamidopropyl amine, isostearamidopropyl dimethylamine, isostearamidopropyl morpholine, laurmidopropyl dimethylamine, linoleamidopropyl dimethylamine, oatamidopropyl dimethylamine, oleamidopropyl dimethylamine, olivamidopropyl dimethylamine, palmitamidopropyl diethylamine, palmitamidopropyl dimethylamine, ricinoleamidopropyl dimethylaamine, sesamidopropyl dimethylamine, ricinoleamidopropyl dimethylamine, soyamidopropyl dimethylamine, stearamidoethyl dimethanolamine, stearamidoethyl diethylamine, stearamidopropyl ethanolamine, stearamidpropyl dimethylamine, stearamidopropyl morpholine, sunflowerseedamidopropyl dimethylamine, tallamidopropyl dimethylamine, tallowamidopropyl dimethylamine, wheat geramidopropyl dimethylamine.

To provide desired cationic surfactants for use in the present hand wash formulations, these non-neutralized amidoamine compounds are neutralized with virtually any organic or inorganic acid. Appropriate organic compounds include, but are not limited to, carboxylic acids, organic acid anhydrides and mixed acid anhydrides. A non-exhaustive list of useful neutralizing agents includes linear carboxylic acids, such as acetic acid and glycolic acid; homocyclic carboxylic acids, such as acetylsalicylic acid, hetrocyclic carboxylic acids, such as nicotinic acid; aromatic carboxylic acids, such as benzoic acid; branched aliphatic carboxylic acids, such as isopropanoic acid; polyprotic carboxylic acids, such as oxalic acid and succinic acid; and organic and mixed anhydrides, such as benzoic acid anhydride and mixed phosphoanhydride. Suitable inorganic acids may include, but are not limited to, strong and weak polyprotic acids such as sulfuric acid and phosphoric acid; monoprotic weak acids, such as sodium bisulfate; monoprotic strong acids, such as hydrogen halides and perchloric acid, and inorganic acid anhydrides, such as carbon dioxide.

Thus, using amindoamines and neutralizing acids as described above, the cationic surfactants may include, for example, behenamidopropyl dimethylamine behenate, behenamidopropyl dimethylamine lactate, cocamidopropyl dimethylamine dihydroxymethylpropionate, coamidopropyl dimethylamine lactate, cocamidopropyl dimethylamine propionate, coamidopropyl morpholine lactate, isostearamidopropyl dimethylamine gluconate, isostearamidopropyl dimethylaimin glycolate, isostearamidpropyl dimethylamine lactate, lauramidopropyl dimethylamine propionate, linoleamidopropyl dimethylaimine dimmer dilinoleate, oleamidopropyl dimethylaimine glycolate, oleamidopropyl dimethylamine lactate, olemidopropyl dimethylamine propionate, olivamidopropyl dimethylamine lactate, palmitamidopropyl dimethylamine lactate, palmitamidopropyl dimethylamine propionate, palmitoleamidopropyl dimethylamine lactate, palmitoleamidopropyl dimethylamine propionate, ricinoleamidopropyl dimethylamine lactate, stearamidoethyl diethylamine phosphate, stearamidoethyl ethanolamine phosphate, stearamidopropyl dimethylamine lactate, stearamidopropyl dimethylamine stearate, sunflowerseedamidopropyl dimethylamine lactate, sunflowerseedamidopropyl dimethylamine malate, sunflowerseedamidopropyl morpholine lactate, wheat germamidopropyl dimethylamine lactate, decarboxy camosine HCl, and stearamidopropyl morpholine lactate.

The addition of the acid to neutralize the amidoamine can occur in nearly any molar ratio. Although the amidoamine can be fully neutralized (i.e., with an acid to amidoamine molar ratio of greater than or equal to 1), in accordance with this invention, it might be found beneficial in some instances to permit an excess of amidoamine (i.e., with an acid to amidoamine molar ratio of less than 1), to exist after neutralization. Equal neutralization (i.e., with an acid to amidoamine molar ratio equal to 1), is most desired, but is not necessary because excess acid or amidoamine does not inhibit antimicrobial properties of the hand wash. Leaving unneutralized amidoamine might be beneficial because amidoamines oftentimes, when not neutralized act as a skin and hair conditioning agent in cosmetic solutions. An excess of acid, while acceptable, is preferably avoided due to the potential for irritancy.

The cationic surfactants of this invention are suitably compatible with active ingredients such that they maintain the antimicrobial efficacy while still allowing for an increase in foam quality when it is desired to provide the hand wash formulation as foam. Given the substantial commercial success of foamed hand washes, it is envisioned that a foaming hand wash formulation in accordance with this invention will be most preferred by end consumers.

In its most basic form, the antimicrobial hand wash may contain the above ingredients (i.e., at least one active ingredient and at least one acid-neutralized amidoamine surfactant), with a balance of water. Generally, however, additional surfactant packages and property-modifying ingredients will be used in typical amounts to create an acceptable product for consumer use.

The hand wash formulations of this invention are typically comprised of from about 0.01 to 10 weight percent (wt %) of active ingredient. In particular embodiments, the active ingredient makes up from about 0.05 to 2 wt % of the formulation, and, in other embodiments, from about 0.1 to 0.5 wt %. The amidoamine based cationic surfactant may be present in the hand wash formulation in amounts of from 0.1 to 20 wt % preferably 0.5 to 7.5 wt %, and more preferably, from 1 to 5 wt %. The amount of amidoamine based cationic surfactant found in the formulation varies with the type of active ingredient used in the hand wash. Any active ingredient which is not water soluble there is a minimum amount of neutralized amidoamine required to solubilize the material. This has been found to be 2.5 w/w %, but there is not upper limit for the amount of neutralized amidoamine. For those active ingredients that are soluble in water, there is no minimum or maximum amount of neutralized amidoamine required. The percentages given above are suggestions for the best aesthetic properties of the hand wash formulation.

Many other optionally ingredients may be employed, as generally known. These ingredients include skin conditioning agents, pH adjusting agents, foaming agents (if desired to foam), preservatives, dyes, fragrances, and the like. They are employed for traditional purposes and in traditional amounts.

Many antimicrobial hand washes present in the market have a concentration of solids between 12 and 30%, most falling between 12 and 20% solids. The formulations produced in accordance with this invention may have, from the quantities prescribed above, a maximum percent of solids of about 30 wt % (20 wt % from the cationic surfactant and 10 wt % of the active ingredient). Preferably, the formulations of this invention include a maximum percent of solids of less than 15 wt %, more preferably less than 12% and even more preferably less than 10%. In yet other embodiments that percent of solids is preferably less than 5.4% solids, derived from the prescribed 0.4 wt % of active ingredient and 5 wt % of acid-neutralized amidoamine. Notably, most antimicrobial hand washes on the market today have a solids content of from about 12 to 15 wt %. The decreased total solids in the present formulations yield a decrease in irritancy and formula cost, while maintaining aesthetic properties.

Particularly preferred cationic surfactants include the salts of lauramidopropyl dimethylamine, cocamidopropyl dimethylamine, and ricinoleamidopropyl dimethylamine neutralized with citric acid, glutaric acid, oxalic acid, sulfuric acid, or hydrochloric acid, more preferably with glycolic acid, malic acid, itaconic acid, nicotinic acid, benzoic acid, acetylsalicylic acid, serine, boric acid, formic acid, propionic acid, succinic acid, or adipic acid, and, even more preferably, with lactic acid. These have been found to advantageously dissolve phenolic compounds, particularly the more preferred triclosan and pcmx compounds, such that, when they are used, the hand wash formulation may be produced through a cold process, whereas, in the prior art, it has been necessary to heat phenolic compound solutions to solubilize the phenolic compound. When employed, a lesser amount of total surfactants is necessary because the phenolic compound is dissolved, thereby making it useful in the end formulation. Because surfactants can be irritating to the skin, their reduction in the hand wash formulation is advantageous, providing formulations with increased wash properties, due to the solubilized active ingredients, and minimal irritating ingredients, due to the use of a lesser amount of surfactants.

In accordance with this cold process, the soluble phenol compound active ingredient is combined with the cationic surfactant, and they are mixed until at least a portion of the active ingredient has dissolved. Preferably, the entire active is dissolved. This mixture, with at least a portion of the active dissolved therein, is termed herein as "active ingredient premix." The active ingredient premix is ultimately combined with a "master-batch mix," which is defined herein to be water and any desired optional ingredients. The active ingredient premix is then mixed with the master-batch mix to create the end hand wash product. Alternatively, the water and other optional ingredients can be added directly to the active ingredient premix and physically mixed.

EXPERIMENTAL

Example 1

The following example shows various amidoamines and their antimicrobial performance when combined with triclosan. The samples were made using IRASAN 300DP, a commercially available tricolsan from Ciba Specalities (United States of America), Mackine™, and various amidoamines from McIntyre Group Ltd. (United States of America), and Purac Hi-Pure USP 90%, a lactic acid from Purac (United States of America).

First, the amidoamine and the lactic acid were mixed and allowed to react. Enough lactic acid was added to bring the solution to a pH of 5.25. While mixing, the triclosan was added to the solution. After the triclosan was fully dissolved, water was added to make a 100 g batch. The samples were then submitted for microbial time-kill testing. The formulation is generally shown below:

| Chemical | Amount | |
|---|---|---|
| Processed Water | q.s. to 100 g | |
| Amidoamine | 2.1 g | |
| Triclosan | 0.3 g | Ciba Specalities (Irgasan DP300) |
| Lactic Acid | q.s. to pH 5.25 | Purac (Purac HiPure USP 90%) |

This formulation was followed for the following Amidoamines:

| | |
|---|---|
| Lauramidopropyl dimethylamine | McIntryre Group Ltd., Mackine ™ 801, USA |
| Cocamidopropyl dimethylamine | McIntryre Group Ltd., Mackine ™ 101, USA |
| Ricinoleamidopropyl dimethylamine | McIntryre Group Ltd., Mackine ™ 201, USA |
| Wheat germamidopropyl dimethylamine | McIntryre Group Ltd., Mackine ™ 701, USA |
| Soyamidopropyl dimethylamine | McIntryre Group Ltd., Mackine ™ 901, USA |
| Isostearamidopropyl dimethylamine | McIntryre Group Ltd., Mackine ™ 401, USA |

A log reduction test was performed for each formulation having a different amidoamine. As known, log reduction is the logarithmic value quantifying the decrease of viable bacteria in a solution. Log reduction is related to percent reduction such that:

1 log=90% reduction,
2 log=99% reduction,
3 log=99.9% reduction, and so on. The samples were tested by placing a loopful (approx 10 microliters) of the formulation into a microbial broth (either *E. coli* or *Staph. aureus*) for 15 seconds. A sample was then taken from the broth and plated. The bacteria was grown and then counted resulting in a quantitative reduction value, as shown in Table 1.

TABLE 1

Results for various Amidoamines:

| | Log Reduction | |
|---|---|---|
| | *Escheria coli* | *Stapholococcus aureus* (#12228) |
| lauramidopropyl dimethylamine | >6.0 | >6.0 |
| cocamidopropyl dimethylamine | >6.0 | >6.0 |
| ricinoleamidopropyl dimethylamine | >6.0 | >6.0 |
| wheat germamidopropyl dimethylamine | 0.4 | Not Tested |
| soyamidopropyl dimethylamine | 0.7 | Not Tested |
| isostearamidopropyl dimethylamine | 0.4 | Not Tested |

The first three amidoamines showed a log reduction of greater than 6 (i.e., 99.9999% reduction). The other three compounds all had poor log reduction of *E. coli,* and, because of this low kill, they were not tested against the more difficult to reduce *Staph. aureus* microorganism.

Example 2

This example shows tests of formulations in accordance with Example 1, but with active ingredients other than triclosan, replacing the triclosan ingredient in the amount as shown below.

| | | Log Reduction: | |
|---|---|---|---|
| Chemical | Amount | *E. coli* | *Staph. aureus* (#12228) |
| PCMX | 0.25 g | >5.9 | >5.7 |
| CHG (20:80 chg:water) | 20.03 g | >5.9 | >5.7 |
| Benzethonium Chloride | 0.10 g | >5.9 | 0.01 |

-continued

| Chemical | Amount | Log Reduction: *E. coli* | *Staph. aureus* (#12228) |
|---|---|---|---|
| Benzalkonium Chloride | 0.02 g | >5.9 | 0.01 |
| Povidone-Iodine (10:90 PI:water) | 11.03 g | >5.9 | >5.7 |

Lauramidopropyl dimethylamine lactate was the amidoamine employed. The results show that this amidoamine is able to work with many different chemical classes, from cationic compounds to phenolic compounds to iodine. The active ingredients tested included parachlorometaxylenol (PCMX), chlorohexidene gluconate (CHG), benzethonium chloride, benzalkonium-chloride, and povidone-iodine.

The two samples containing the quaternary ammonium active ingredients had very poor log reduction values for the *Stapholococcus aureus* (#12228), but this was expected because other prior formulations using the quaternary ammonium compounds as actives have low log reduction on this organism. The other active ingredients show no degradation in inhibitory abilities when combined with the amidoamine.

Example 3

In the following example various acids were employed to neutralize lauramidopropyl dimethylamine (McIntyre Group Ltd. Mackine™ 801), and the log reduction of the resulting hand wash formulation was determined, as shown in Table 2. Multiple classes of acids were used in combination with the amidoamine to produce a solution at a pH of 5.25+/−0.50. In this example, the triclosan (Ciba Specalities Irgasan 300DP) was mixed with propylene glycol (Dow Chemical Company: Propylene Glycol USP) until all of the triclosan was dissolved. The lauramidopropyl dimethlyamine was added to the water and then the solution was adjusted with the desired acid to pH 5.25+/−0.5. Once the pH was adjusted, the propylene glycol/triclosan premix was added to the water solution.

Although this approach was not used in the prior examples, it allowed for quick batching through faster triclosan solubilization. The cationic surfactant dissolves the triclosan, not the non-ionic form of the compound, and as such the surfactant must first be neutralized to dissolve the triclosan. This neutralization reaction needed to take place in an aqueous environment to permit pH tracking to ensure the appropriate stopping point of the reaction. Therefore, each sample would need to be prepped twice, once for proper acid amount, and a second time for triclosan dissolving, so adding propylene glycol to the solution side-stepped this necessity. There is a sample containing lauramidopropyl dimethylamine neutralized with lactic acid as a control to ensure the propylene glycol does not alter the antimicrobial properties of the hand wash.

The formula below was followed, the acids employed being shown in Table 2:

| Chemical | Amount |
|---|---|
| Water | q.s. to 100 g |
| Lauramidopropyl dimethylamine | 2.1 g |
| Triclosan | 0.303 g |

-continued

| Chemical | Amount |
|---|---|
| Acid | q.s. to pH 5.25 |
| Propylene Glycol | 5.0 g |

TABLE 2

| Acid | Amount Used | *Enterococcus faecium* | *Staphlococcus aureus* (#12228) |
|---|---|---|---|
| Malic Acid (Acros) | 0.51 g | >6.0 | >6.0 |
| Adipic Acid (Acros) | 1.12 g | 5.9 | >6.0 |
| Succininc Acid (Acros) | 0.52 g | >6.2 | >6.0 |
| Nicotinic Acid (Aldrich) | 0.98 g | >6.6 | >6.9 |
| Citric Acid (Aldrich) | 0.60 g | 3.6 | 3.7 |
| Phosphoric Acid (Monsanto) | 0.69 g | 1.2 | >6.9 |
| Tartaric Acid (Fisher) | 0.70 g | 1.6 | >6.9 |
| Sodium Bisulfate (Fisher) | 1.26 g | 3 | >6.9 |
| Gluconic Acid (Aldrich) | 4.51 g | 1.8 | >6.6 |
| Glutamic Acid (Aldrich) | 1.19 g | 1 | >6.6 |
| Glycolic Acid (Aldrich) | 0.58 g | >6.5 | >6.6 |
| Acetylsalicylic Acid (Acros) | 1.31 g | >6.5 | >6.6 |
| Serine (Aldrich) | 5.28 g | >6.5 | >6.5 |
| Sulfuric Acid (Fisher) | 1.89 g | 3 | >6.6 |
| Boric Acid (Fisher) | 3.75 g | >6.5 | >6.6 |
| Hydrochloric Acid (Fisher) | 13.56 g | 1.9 | >6.6 |
| Propionic Acid (Fisher) | 0.68 g | >6.5 | >6.6 |
| Oxalic acid (Fisher) | 0.34 g | 2.6 | >6.6 |
| Glutaric Acid (Acros) | 0.56 g | 2.5 | >6.6 |
| Itaconic Acid (Acros) | 0.61 g | >6.5 | >6.6 |
| Malonic Acid (Acros) | 0.55 g | >6.5 | >6.6 |
| Benzoic Acid (Acros) | 1.11 g | >6.5 | >6.6 |
| Phenol | 2.53 g | >6.5 | >6.6 |

Example 4

Although triclosan can dissolve into numerous solvents, the addition of water quickly causes it to precipitate. Thus, solubilizers are often employed to prevent such precipitation. Common solubilizers include glycols, mainly propylene and dipropylene glycol, and alcohols, usually ethyl alcohol. Notably, these must be in an aqueous solution at much higher levels than the amidoamines concentrations herein to prevent triclosan precipitation.

To test the ability of lauramidopropyl dimethylamine lactate to dissolve the active triclosan, solutions were made by dissolving triclosan into different solubilizers and comparing these to a solution made by dissolving triclosan into lauramidopropyl dimethylamine lactate. This was done with constant mixing of solution until there were no visible crystals. The solutions were then added into water and mixed to observe whether or not precipitation of the triclosan occurred. When it did occur the solution became translucent to opaque with a white to slight bluish hue.

The solutions were made according to the following formula:

| Chemical | Amount |
|---|---|
| Solubilizer | 20 g |
| Triclosan (Ciba Specalities) | 2.00 g (* this is termed "Active Premix") |
| Deionized Water | 194 g |
| Active Premix | 6 g |

TABLE 3

| Solublizer | Precipitation (y/n?) |
|---|---|
| Alcohol: SDA 3-C, 190 Proof (Equistar Chemicals) | Y |
| Propylene Glycol (Dow Chemical Co.) | Y |
| Dipropylene Glycol (Huntsman Protochem) | Y |
| Lauramidopropyl dimethylamine lactate (McIntyre Group Ltd.) | N |

It can be seen that, although all of the common solubilizers dissolve triclosan, they cannot keep the triclosan in solution. Only the lauramidopropyl dimethylamine lactate both dissolved triclosan and prevented triclosan precipitation upon dilution.

Example 5

This next experiment examined the foaming ability of a few triclosan compatible amidoamine based surfactants, i.e. the neutralized cationic surfactant amidoamines that function well with triclosan, and amine oxides, lauramidopropyl oxide and cocamine oxide.

The amidoamine formulations followed as such:

| Chemical: | Amount: | Supplier: |
|---|---|---|
| Water | q.s. to 100 g | N/A |
| Amido-amine | 2.2 g | McIntyre Group Ltd., Mackine 201, 1001 or 801 |
| Lactic Acid | q.s. to pH: 5.0 | Purac, Purac HiPure USP 90% |
| Triclosan | 0.3 g | Ciba, IrgasanDP300 |

The amidoamine based hand washes were added to deionized water. One gram of the hand wash and 99 grams of the water were mixed. The two amine oxides were diluted straight from the surfactant mix to create solutions of the same concentration as with the amidoamine based surfactants, 0.06 g of cocamine oxide or lauramidopropylamine oxide solution, 30 w/w %, to water. Once the surfactants were combined with the water in a 500 mL graduated cylinder, they were capped and inverted ten times. Once done, the solution sat undisturbed for 5 minutes without a top. An initial foam height was measured just after inversions and then after the five minute period. The results are shown in Table 4.

TABLE 4

| Chemical | Flash Foam (mm) | Stable Foam (mm) |
|---|---|---|
| Lauramidopropyl dimethylamine lactate | 110 | 105 |
| Cocamidopropyl dimethylamine lactate | 105 | 105 |
| Ricinoleamidopropyl dimethylamine lactate | 25 | 20 |
| Lauramidopropylamine oxide | 75 | 25 |
| Cocamine oxide | 105 | 25 |

The lauramidopropyl dimethylamine lactate, although at a concentration of 0.2 wt % still produced over 100 mL of foam, the highest of all the surfactants tested. With only a decrease of 5 mL of foam, it is unquestionably stable. Because of its relatively short chain length the surfactant foams more readily than the longer chains, as in the case of the ricinoleamidopropyl dimethylamine lactate.

Example 6

This example employs the lactic acid-neutralized lauramidopropyl dimethylamine surfactant with triclosan and tests it against numerous organisms for time kill testing, as per Example 1. The production process followed that of Example 1: neutralization of the amidoamine with lactic acid followed by the addition of triclosan. After the triclosan was completely dissolved to form the 'active premix,' the active premix was added to the water and mixed until homogenous. The formulation was as follows:

| Chemical | Percent (wt %) | Supplier |
|---|---|---|
| Lauramidopropyl dimethylamine | 2.00 | McIntyre Group (Mackine 801) |
| Lactic Acid | 0.83 | Purac, Purac Hi-Pure USP 90% |
| Triclosan | 0.30 | Ciba, Irgasan DP300 |
| Water | q.s. to 100 | |

Table 5 shows the log reduction of various organisms with the above hand wash formulation. Note the sample is highly effective against both gram negative and gram positive bacteria.

TABLE 5

| Organism | Log Reduction | Gram Stain |
|---|---|---|
| *Corynebacterium diptheriae* (#11913) | 4.5 | Positive |
| *Enterbacter aerogenes* (#13048) | 4.7 | Negative |
| *Enterococcus faecalis* (#29212) | 4.5 | Positive |
| *Enterococcus faecium* (#51559) | 7.6 | Positive |
| *Escherichia coli* (#11229) | 7.6 | Negative |
| *Escherichia coli* (#25922) | 4.7 | Negative |
| *Escherichia coli* (#35150) | 5.1 | Negative |
| *Klebsiella pheumoniae* (#11296) | 5.2 | Negative |
| *Klebsiella pneumoniae* (#13883) | 5.1 | Negative |
| *Listeria monocytogenes* (#7644) | 5.1 | Positive |
| *Micrococcus luteus* (#7468) | 4.7 | Positive |
| *Proteus mirabilis* (#7002) | 5.1 | Negative |
| *Pseudomonas aeruginosa* (#15442) | 5.2 | Negative |
| *Pseudomonas aeruginosa* (#27853) | 4.5 | Negative |
| *Salmonella cholerasius* (#10708) | 5.1 | Negative |
| *Serratia marcescens* (#14756) | 7.6 | Negative |
| *Shigella sonnei* (#11296) | 5.2 | Negative |
| *Staphylococcus aureus* (#6538) | 7.6 | Positive |
| *Staphylococcus aureus* (#29213) | 5.2 | Positive |
| *Staphylococcus aureus* (#33591) | 5.1 | Positive |
| *Staphylococcus epidermis* (#12228) | 5.1 | Positive |
| *Staphylococcus haemolyticus* (#43253) | 4.7 | Positive |
| *Staphylococcus hominis* (#29885) | 4.5 | Positive |

What is claimed is:

1. An antimicrobial hand wash comprising:

i. an active ingredient selected from the group consisting of phenolic compounds, and mixtures thereof; and ii. a cationic surfactant selected from the group consisting of lauramidopropyl dimethylamine, cocamidopropyl dimethylamine, or ricinoleamidopropyl dimethylamine, neutralized with an acid selected from the group consisting of citric acid, glutaric acid, oxalic acid, sulfuric acid, hydrochloric acid, glycolic acid, malic acid, itaconic acid, nicotinic acid, benzoic acid, acetylsalicylic acid, serine, boric acid, formic acid, propionic acid, succinic acid, adipic acid, lactic acid, and mixtures thereof.

2. The hand wash of claim 1, wherein said phenolic compound is selected from the group consisting of:

(a) 2-hydroxydiphenyl compounds according to the following formula

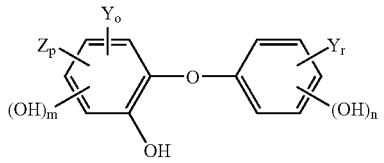

wherein Y is chlorine or bromine, Z is $SO_2H$, $NO_2$, or $C_1$-$C_4$ alkyl, r is 0 to 3, o is 0 to 3, p is 0 or 1, m is 0 or 1, and n is 0 or 1;

(b) phenol derivatives according to the following formula

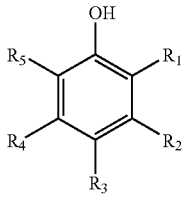

wherein $R_1$ is hydro, hydroxy, $C_1$-$C_4$ alkyl, chloro, nitro, phenyl, or benzyl; $R_2$ is hydro, hydroxy, $C_1$-$C_6$ alkyl, or halo; $R_3$ is hydro, $C_1$-$C_6$ alkyl, hydroxy, chloro, nitro, or a sulfur in the form of an alkali metal salt or ammonium salt; $R_4$ is hydro or methyl; and $R_5$ is hydro or nitro; and (c) Diphenyl Compounds according to the following formula:

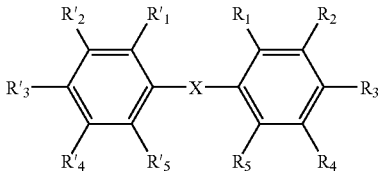

wherein X is sulfur or a methylene group, $R_1$ and $R'_1$ are hydroxy, and $R_2$, $R'_2$, $R_3$, $R'_3$, $R_4$, $R'_4$, $R_5$, and $R'_5$, independent of one another, are hydro or halo.

3. The hand wash of claim 1, wherein the active ingredient is selected from the group consisting of 2,3,4'-trichloro-2'-hydroxydiphenylether, parachlorometaxylenol and mixtures thereof.

4. The hand wash of claim 3, wherein the active ingredient is 2,3,4'-trichloro-2'-hydroxydiphenylether, and the cationic surfactant is lauramidopropyl dimethylamine lactate.

5. The hand wash of claim 1, comprised of from about 0.01 to 10 weight percent (wt %) of active ingredient.

6. The hand wash of claim 5, comprised of from about 0.1 to 20 wt % of said cationic surfactant.

7. The hand wash of claim 6, comprised of from 0.5 to 7.5 wt % of said cationic surfactant.

8. The hand wash of claim 1, having a maximum percent of solids of less than 15 wt %.

9. A method for forming a hand wash comprising the steps of:

creating an active ingredient premix by mixing a phenolic compound active ingredient with the cationic surfactant of claim 1, said mixing effecting at least a partial dissolving of the phenolic compound without the need for the addition of heat to dissolve the same; and mixing said active ingredient premix with water.

* * * * *